US006198035B1

(12) United States Patent
Saito et al.

(10) Patent No.: US 6,198,035 B1
(45) Date of Patent: Mar. 6, 2001

(54) MUSICAL SOUND SIGNAL GENERATION APPARATUS

(75) Inventors: Tsutomu Saito, Shizuoka-ken; Jiro Tanaka, Hamamatsu, both of (JP)

(73) Assignee: Kabushiki Kaisha Kawai Gakki Seisakusho, Shizuoka-Ken (JP)

( * ) Notice: Subject to any disclaimer, the term of this patent is extended or adjusted under 35 U.S.C. 154(b) by 0 days.

(21) Appl. No.: 09/504,647

(22) Filed: Feb. 14, 2000

(30) Foreign Application Priority Data

Feb. 15, 1999 (JP) ..... 11-036423
Feb. 17, 1999 (JP) ..... 11-038785

(51) Int. Cl.[7] ..... G10H 7/00; G10H 1/18

(52) U.S. Cl. ..... 84/617; 84/600; 84/615; 84/653; 84/655

(58) Field of Search ..... 84/600–608, 615–618, 84/622, 633, 653–656, 659, 665

(56) References Cited

U.S. PATENT DOCUMENTS 5,315,059 * 5/1994 Saito ..... 84/656
5,783,766 * 7/1998 Tanaka ..... 84/618
5,804,755 * 9/1998 Furukawa ..... 84/656

FOREIGN PATENT DOCUMENTS 10-49159 2/1998 (JP) .

* cited by examiner

*Primary Examiner*—David Martin
*Assistant Examiner*—Marlon Fletcher
(74) *Attorney, Agent, or Firm*—Davis and Bujold

(57) ABSTRACT

There is disclosed a musical sound signal generation apparatus for creating vacant channels by monaural sounding, in which a left/right balance is maintained and the total sound volume can be increased. When there is a key-on, and there is no vacant channel, a pair of channels for stereo sounding are selected, one channel of the pair of channels is released at a high rate, the panning coefficient of the other channel is changed, and a monaural sound is outputted from left and right output systems. Similarly, another pair of channels are selected, one channel of the pair of channels is released at the high rate, the panning coefficient of the other channel is changed, and the monaural sound is outputted from the left and right output systems. The L and R channels of the new key-on are assigned to two vacant channels.

16 Claims, 12 Drawing Sheets

FIG. 4

| | | | LOW TONE | MEDIUM TONE | HIGH TONE |
|---|---|---|---|---|---|
| 1 | L SIDE DCO | WAVE START ADDRESS | | | |
| 2 | | L SIDE PANNING COEFFICIENT | ( 70 ) | ( 70 ) | ( 70 ) |
| 3 | | R SIDE PANNING COEFFICIENT | ( 0 ) | ( 0 ) | ( 0 ) |
| 4 | | Attack Env. DATA | | | |
| 5 | | Decay Env. DATA | | | |
| 6 | | Release Env. DATA | | | |
| 1 | R SIDE DCO | WAVE START ADDRESS | | | |
| 2 | | L SIDE PANNING COEFFICIENT | ( 0 ) | ( 0 ) | ( 0 ) |
| 3 | | R SIDE PANNING COEFFICIENT | ( 70 ) | ( 70 ) | ( 70 ) |
| 4 | | Attack Env. DATA | | | |
| 5 | | Decay Env. DATA | | | |
| 6 | | Release Env. DATA | | | |

MUSICAL SOUND SIGNAL GENERATION APPARATUS

BACKGROUND OF THE INVENTION (i) Field of the Invention

The present invention relates to a musical sound signal generation apparatus, particularly to an apparatus which can effectively utilize a musical sound generation channel.

(ii) Description of the Related Art

For example, an electronic keyboard instrument represented by an electronic piano includes a musical sound signal generation apparatus. The apparatus is provided with: a plurality of musical sound generation channels; a channel state storage unit for storing the operation state of each musical sound generation channel; an assigning unit for, when a key-on is detected, referring to the storage content of the channel state storage unit to select a pair of musical sound generation channels, assigning a left musical sound signal for stereo performance to one of the selected musical sound generation channels which is an L channel, and assigning a right musical sound signal for the stereo performance to the other channel which is an R channel; a left output system for outputting the left musical sound signal; and a right output system for outputting the right musical sound signal. A left speaker is driven in response to the musical sound signal from the left output system, and a right speaker is driven in response to the musical sound signal from the right output system so that the stereo performance is realized.

To realize the stereo performance, two musical sound generation channels (L/R channels) are necessary for one key operation (key-on). If the pairs of L/R channels are prepared for the number of keys, a shortage of channels is not caused. However, the increasing of the number of the musical sound generation channels increases costs. Therefore, a technique of suppressing the number of musical sound generation channels to some degrees (e.g., 32 channels), and effectively utilizing a limited number of musical sound generation channels has been researched.

As one of such techniques of effectively utilizing the musical sound generation channels, a musical sound signal generation apparatus is disclosed in Japanese Patent Application Laid-Open No. 49159/1998. In this musical sound signal generation apparatus, when a new key-on is made during use of all the musical sound generation channels, two pairs of L/R channels are selected, one of the musical sound generation channels constituting the pair is truncated (rapidly attenuated), and the remaining channel is allowed to operate as it is. Thereby, since two musical sound generation channels become vacant, they can be used as the L/R channels for the key subjected to the new key-on.

In the technique of the Japanese Patent Application Laid-Open No. 49159/1998, however, since only the sounding of one-side channel remains out of stereo sounding, sound volume balance is lost on the left and right. To prevent this, the channel to be truncated needs to be controlled so that since the L channel was truncated the last time, the R channel is to be truncated this time. Such complicated control is necessary.

Moreover, the sounding of the one-side channel is completely eliminated by the truncation processing. For example, when the key-on is successively made with a damper pedal stepped on, the total sound volume is desired to gradually increase. However, the total number of channels cannot be increased to obtain the stereo sound volume or more volume.

SUMMARY OF THE INVENTION

Wherefore, an object of the present invention is to provide a musical sound signal generation apparatus in which stereo sounding is enabled, and a musical sound generation channel can effectively be utilized.

Another object of the present invention is to provide a musical sound signal generation apparatus in which one of the musical sound generation channels having emitted stereo sound is truncated, the truncated channel is used for sounding a key subjected to a new key-on, and the total sound volume can be increased in accordance with the key-on without deteriorating a left/right balance.

To attain these and other objects, a first aspect of the present invention provides a musical sound signal generation apparatus provided with: a plurality of musical sound generation channels for generating musical sound signals; a channel state storage unit for storing the operation state of each of the musical sound generation channels; an assigning unit for, when a key-on is detected, referring to the storage content of the channel state storage unit to select a pair of the musical sound generation channels, assigning a left musical sound signal for stereo performance to one of the selected musical sound generation channels which is an L channel, and assigning a right musical sound signal for the stereo performance to the other channel which is an R channel; a left output system for outputting the left musical sound signal; and a right output system for outputting the right musical sound signal.

The musical sound signal generation apparatus is characteristically provided with a monaural processing unit for, when the new key-on is detected, referring to the storage content of the channel state storage unit, selecting two pairs of the L channel and R channel corresponding to two keys previously subjected to the key-on, truncating the musical sound signal of one channel of each selected pair of musical sound generation channels, and setting the output destination of the musical sound signal of the other musical sound generation channel to both the left output system and the right output system.

In this musical sound signal generation apparatus, when the new key-on is detected, the monaural processing unit refers to the storage content of the channel state storage unit, selects two pairs of the L and R channels corresponding to two keys previously subjected to the key-on, and truncates the musical sound signal of one channel of each selected pair of musical sound generation channels. Therefore, the channel can be ensured for the new key-on.

Moreover, since the output destination of the musical sound signal of the channel left without being truncated is set to both the left and right output systems, the left/right balance can be maintained.

Furthermore, since the musical sound signal of the remaining channel without being truncated is outputted from both the left and right output systems, the total sound volume can be prevented from decreasing. For example, when the key-on is successively made with the damper pedal stepped on, the total sound volume can gradually be increased.

A second aspect of the present invention provides a musical sound signal generation apparatus characteristically provided with a gradual panning unit for, when the new key-on is detected, referring to the storage content of the channel state storage unit, selecting one pair of the L channel and R channel corresponding to the key previously subjected to the key-on, allowing the panning value of the musical sound signal of one channel of the selected musical sound generation channels to gradually approach zero (hereinafter referred to as the gradual approach to zero), and allowing the musical sound signal of the other musical sound generation channel to gradually approach the panning value based on a key scale during the key-on which is a cue to operate the musical sound generation channel (hereinafter referred to as the gradual approach to the key scale).

According to the second aspect of the invention, the musical sound generation channel whose panning value is allowed to gradually approach zero can be used as the musical sound generation channel corresponding to the new key-on.

Moreover, by allowing the panning value of the musical sound signal of the remaining musical sound generation channel to gradually approach the key scale, the decrease of the sound volume by the approach to zero can be decreased. For example, when the key-on is successively made with the damper pedal stepped on, the total sound volume can gradually be increased.

A third aspect of the present invention provides a musical sound signal generation apparatus characteristically provided with a panning changing unit for, when the new key-on is detected, referring to the storage content of the channel state storage unit, selecting one pair of the L and R channels corresponding to the key previously subjected to the key-on, and changing the panning value of one musical sound generation channel to obtain a sound volume close to the total value of the sound volume outputted by the selected L and R channels in one of the selected L and R channels.

According to the third aspect of the invention, the other musical sound generation channel can be used as the musical sound generation channel corresponding to the new key-on.

Moreover, since the panning value of the musical sound signal of one musical sound generation channel is set to the panning value at which the sound volume close to the total value of the sound volume outputted by the L and R channels, the sound volume can be prevented from decreasing by silencing of the other musical sound generation channel (used for the new key-on). For example, when the key-on is successively made with the damper pedal stepped on, the total sound volume can gradually be increased.

A fourth aspect of the present invention provides a musical sound signal generation apparatus provided with: a plurality of musical sound generation channels for generating musical sound signals; a channel state storage unit for storing the operation state of each of the musical sound generation channels; an assigning unit for, when a new key-on is detected, referring to the storage content of the channel state storage unit to assign the musical sound generation channel to generate the musical sound signal corresponding to the new key-on; and left and right output systems for outputting the musical sound signal generated by the musical sound generation channel. On the detection of the new key-on, the assigning unit is constituted to assign a pair of the musical sound generation channels to generate left and right independent waveforms (hereinafter referred to as stereo-assign) when there is a vacancy of two or more channels in the musical sound generation channel, and to assign one musical sound generation channel to generate only one of the left and right independent waveforms (hereinafter referred to as monaural-assign) when there is no vacancy of two or more channels. The musical sound signal generation apparatus is provided with a panning setting unit for setting a panning coefficient so that the musical sound signal of the musical sound generation channel monaural-assigned by the assigning unit is outputted from the left and right output systems.

In the musical sound signal generation apparatus, on the detection of the new key-on, the assigning unit stereo-assigns a pair of the musical sound generation channels to generate the left and right independent waveforms, when there is a vacancy of two or more channels in the musical sound generation channel.

However, when there is no vacancy of two or more channels, the assigning unit monaural-assigns one musical sound generation channel to generate only one of the left and right independent waveforms. When there is no vacant channel, and when there is a shortage of musical sound generation channels to be assigned for the new key-on on the detection of the new key-on, the assigning unit selects any one from the already assigned musical sound generation channels, and can assign the new key-on to the selected musical sound generation channel. Additionally, two channels to be stereo-assigned may be selected from the already assigned musical sound generation channels.

Moreover, the panning setting unit sets the panning coefficient so that the musical sound signal of the musical sound generation channel monaural-assigned by the assigning unit is outputted from the left and right output systems.

A fifth aspect of the present invention provides a musical sound signal generation apparatus provided with: a plurality of musical sound generation channels for generating musical sound signals; a channel state storage unit for storing the operation state of each of the musical sound generation channels; an assigning unit for, when a new key-on is detected, referring to the storage content of the channel state storage unit to assign the musical sound generation channel to generate the musical sound signal corresponding to the new key-on; and left and right output systems for outputting the musical sound signal generated by the musical sound generation channel. The assigning unit is constituted to assign (stereo-assign) a pair of the musical sound generation channels to generate left and right independent waveforms when the velocity of the new key-on exceeds a velocity reference value, and to assign (monaural-assign) one musical sound generation channel to generate only one of the left and right independent waveforms when the velocity of the new key-on is equal to or less than the velocity reference value. The musical sound signal generation apparatus is provided with a panning setting unit for setting a panning coefficient so that the musical sound signal of the musical sound generation channel monaural-assigned by the assigning unit is outputted from the left and right output systems.

It goes without saying that when stereo sounding is performed for any key-on, the electronic keyboard instrument can provide concert-hall presence. However, the key-on has a difference in velocity (may be regarded as the intensity of key operation). When the velocity is low, the sound volume is small. Moreover, when the sound volume is small, a difference between stereo sounding and monaural sounding is reduced. Therefore, the monaural sounding may be performed.

As described above, even when the monaural assigning is performed to effectively utilize the musical sound generation channels, there is no sound volume dispersion on the left and right, and a pseudo stereo effect can be obtained by the setting of the panning coefficient, which gives no feeling of difference to players and audience.

Additionally, since only the setting of the panning coefficient is necessary, there is only a small load increase of CPU, and no high-performance (expensive) CPU needs to be employed.

BRIEF DESCRIPTION OF THE DRAWINGS

Preferred embodiments of the present invention will be described with reference to the drawings, in which;

FIG. 4 is an explanatory view showing the structure of a stereo timbre parameter in a timbre parameter ROM of the electronic instrument of the embodiment;

DETAILED DESCRIPTION OF PREFERRED EMBODIMENTS

First Embodiment

Figure 1:
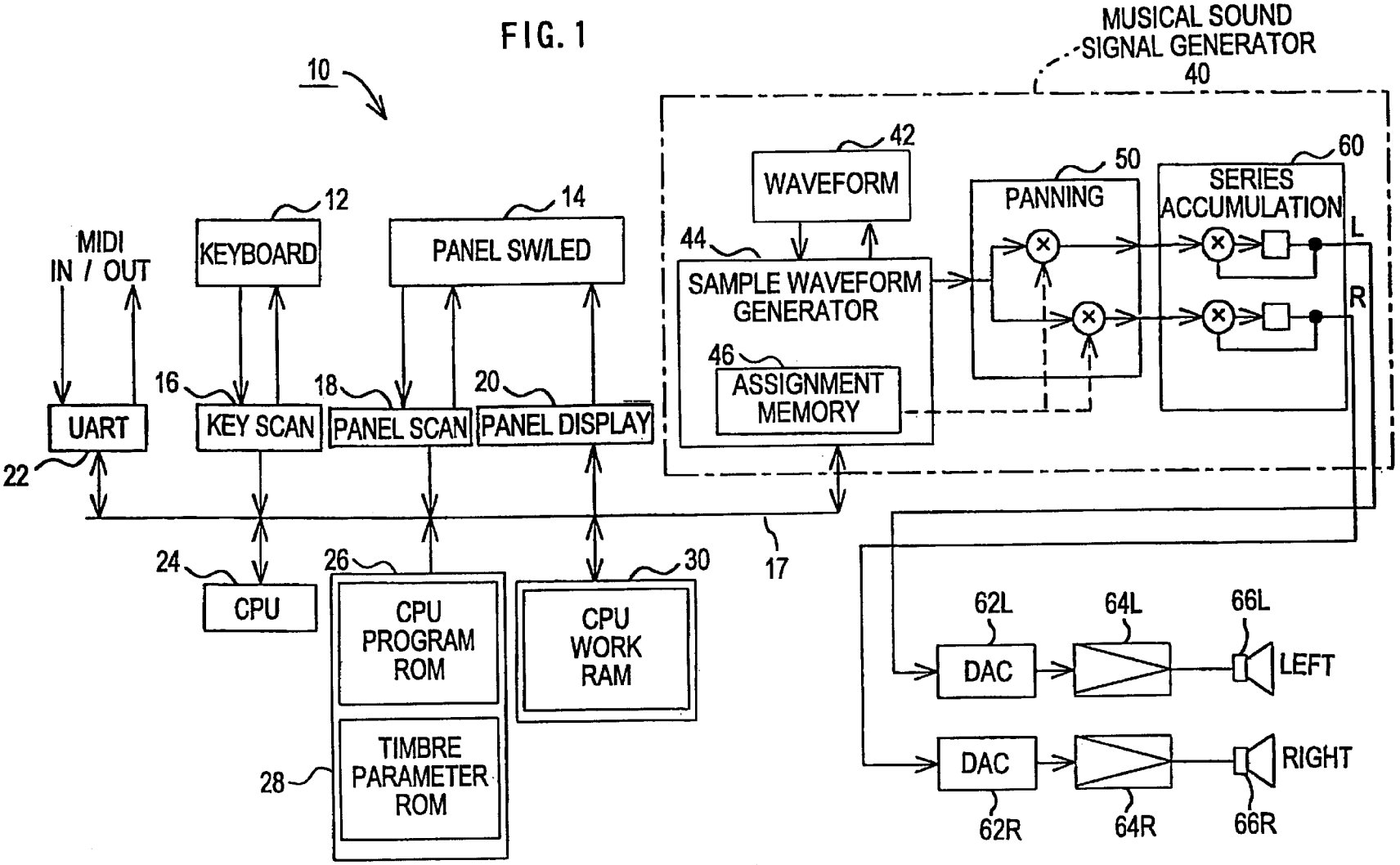
FIG. 1 is a block diagram showing the entire constitution of an electronic instrument of an embodiment.

Referring to FIG. 1, the keyboard type electronic instrument 10 is provided with a keyboard 12 and a panel 14, and a player can operate the keys of the keyboard 12 and the switches of the panel 14.

When the key of the keyboard 12 is operated, a key scan circuit 16 detects key depression and key release, that is, key-on and key-off, and transmits the detected key on/off information with the key number to a bus line 17. The key on/off information and key number transmitted to the bus line 17 are taken into a CPU 24 and a musical sound signal generator 40, and stored in a CPU work RAM 30 under the control of the CPU 24. Additionally, the CPU work RAM 30 stores the operation state of a musical sound generation channel described later, and functions as a channel state storage unit.

The on/off states, positions, and the like of a mode selection switch, timbre selection switch, and volume controller on the panel 14 are detected by a panel scan 18. The switch information is transmitted to the bus line 17 from the panel scan 18, and stored in the CPU work RAM 30 under the control of the CPU 24.

Moreover, a panel display 20 is attached to the panel 14, and on receiving an instruction from the CPU 24 the panel display 20 lights or turn off LED to display the state, and the like of the electronic instrument 10.

Furthermore, the bus line 17 is connected to an UART 22 which is a serial input/output circuit, and MIDI signals are inputted to the UART 22.

The CPU 24 operates according to the operation program stored in a CPU program ROM 26, and controls the operation of each component of the electronic instrument 10.

Figure 5:
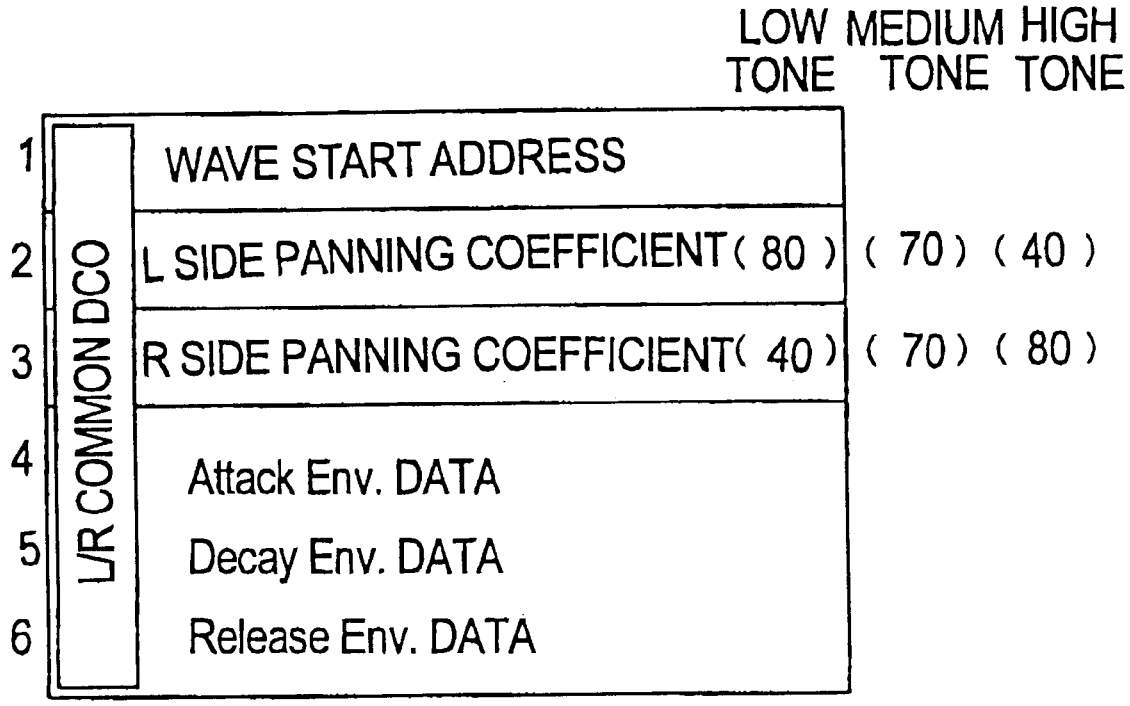
FIG. 5 is an explanatory view showing the structure of a monaural timbre parameter in the timbre parameter ROM of the electronic instrument of the embodiment.

In a timbre parameter ROM 28, stereo timbre parameters structured as shown in FIG. 4, and monaural timbre parameters shown in FIG. 5 are stored. As shown in FIG. 4, for the stereo timbre parameters, L side DCO and R side DCO form a pair for each timbre. Each DCO includes a wave start address, L and R side panning coefficients, and attack, decay and release envelope data. Additionally, in the present embodiment, the L side panning coefficient of the L side DCO is set to 70 for each of low, medium, and high tones, and the R side panning coefficient is set to 0 for each of the low, medium, and high tones. Conversely, in the R side DCO, the L side panning coefficient of the R side DCO is set to 0 for each of low, medium, and high tones, and the R side panning coefficient is set to 70 for each of the low, medium, and high tones.

Moreover, as shown in FIG. 5, for the monaural timbre parameters, an L/R common DCO includes the wave start address, L and R side panning coefficients, and attack, decay and release envelope data. In the present embodiment, the panning coefficients of the monaural timbre parameters accord with panning curves shown in FIG. 6. A panning curve (L) indicating 80 on the low tone side and 40 on the high tone side, and a panning curve (R) indicating 40 on the low tone side and 80 on the high tone side. Specifically, the coefficients are set to 80 on the L side and 40 on the R side for the low tone, to 70 on both sides for the medium tone, and to 40 on the L side and 80 on the R side for the high tone.

Turning back to FIG. 1, the musical sound signal generator 40 is connected to the bus line 17. The musical sound signal generator 40 is provided with: a waveform ROM 42 for storing sample waveform data; a sample waveform generator 44 for generating a sample waveform (musical sound signal) based on the sample waveform data read; an assignment memory 46 of RAM forming a part of the sample waveform generator 44; a panning circuit 60 for applying a panning processing to the sample waveform generated by the sample waveform generator 44; a series accumulation circuit 60 for a series accumulation processing of the sample waveform subjected to the panning processing; and the like.

Additionally, in the musical sound signal generator 40 of the present embodiment, the sample waveform generator 44 is provided with 32 musical sound generation channels for generating the sample waveform, and each channel generates the sample waveform of one tone.

Figure 3:
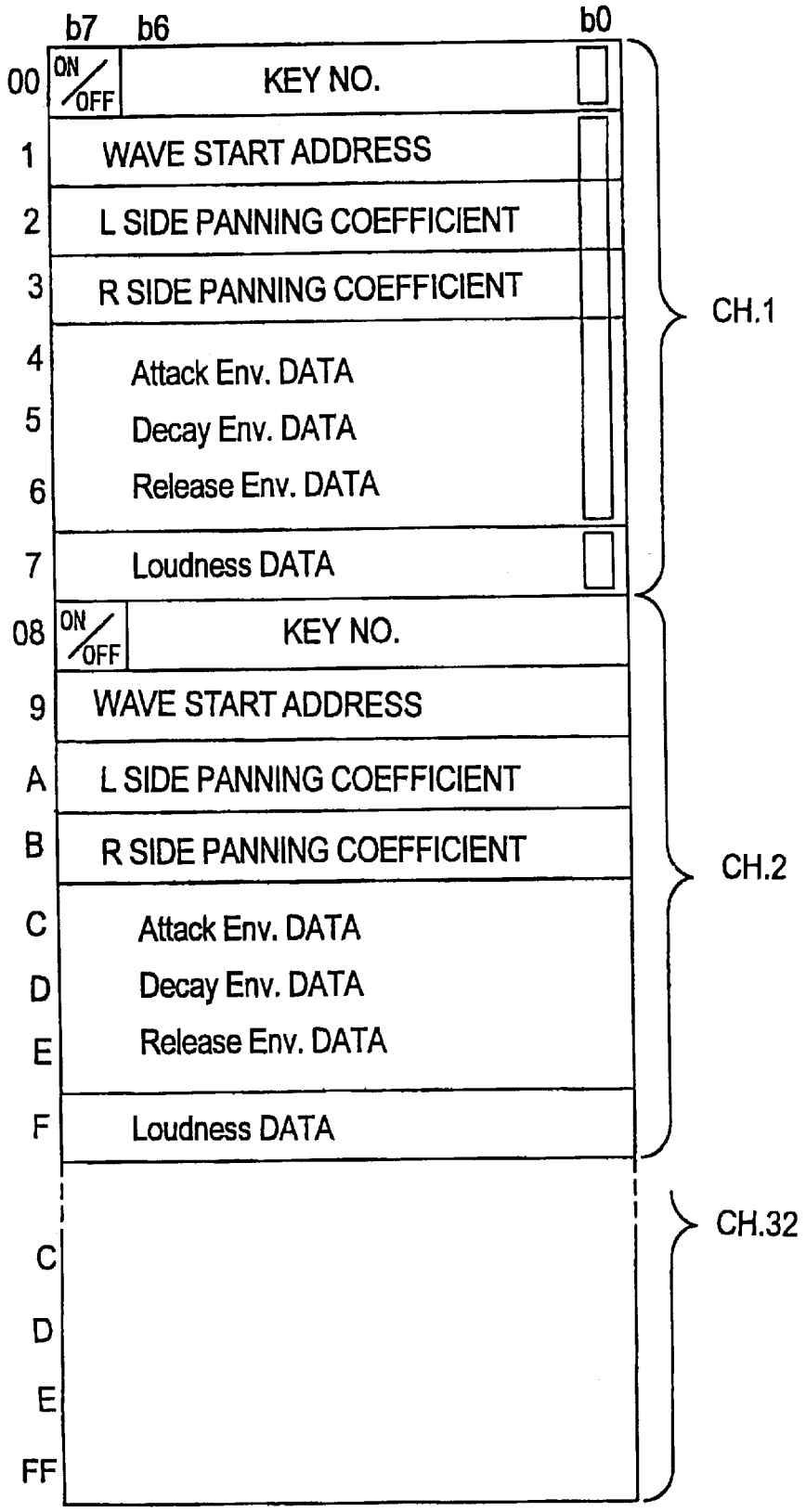
FIG. 3 is an explanatory view showing the structure of an assignment memory of the musical sound signal generation apparatus of the embodiment.

Moreover, the assignment memory 46 stores key assignment information for each channel as shown in FIG. 3. Specifically, the key number, on/off information, wave start address, L and R side panning coefficients, attack, decay and release envelope data, and loudness data form the assignment information for one channel, and 32 channels of the information can be stored in the assignment memory 46.

The stored key number and on/off information are transmitted to the bus line 17 from the key scan circuit 16. The wave start address, L and R side panning coefficients and envelope data are obtained from the timbre parameter ROM 28 based on the timbre selection switch of the panel 14. For the loudness data, the position of the volume controller is detected by the panel scan 18, converted to a numerical value and transmitted to the bus line 17. Specifically, it can be said that the data concerning the key number, timbre and sound volume corresponding to the sample waveform generated for each channel are stored in the assignment memory 46.

Turning back to FIG. 1, the series accumulation circuit 60 is connected to a left output system provided with a digital analog converter (DAC) 62L, amplifier (Amp) 64L and speaker (SP) 66L, and similarly to a right output system provided with DAC 62R, Amp 64R and SP 66R. Each of the left and right output systems can convert a digital signal outputted from the series accumulation circuit 60 to an analog signal, amplify the signal, and output sound.

Figure 2:
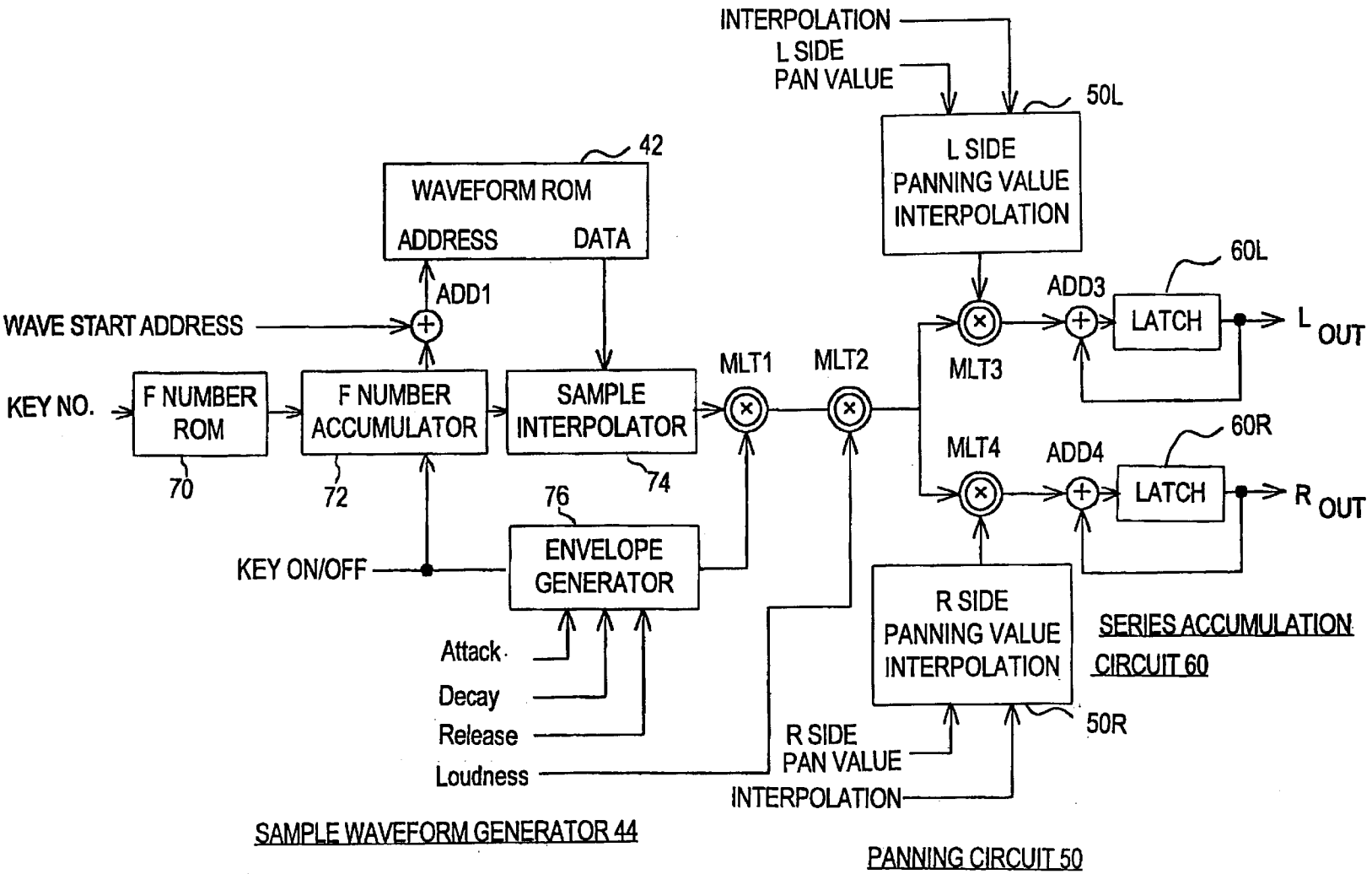
FIG. 2 is a block diagram showing details of a musical sound signal generation apparatus for the electronic instrument of the embodiment.

As shown in FIG. 2, the sample waveform generator 44 is provided with an F number ROM 70, F number accumulator 72, sample interpolator 74, envelope generator 76, assignment memory 46 (not shown in FIG. 2), and the like. Among these, the F number accumulator 72, sample interpolator 74, and envelope generator 76 form a set to generate one sample waveform. Therefore, there are 32 sets, that is, 32 musical sound generation channels in the present embodiment.

Based on the key number from the assignment memory 46, the F number corresponding to the key number is read from the F number ROM 70 into the F number accumulator 72. Moreover, the key on/off information from the assignment memory 46 is also inputted to the F number accumulator 72. The F number accumulator 72 transmits the integer part of F number to an adder ADD1, and the decimal part to the sample interpolator 74. In the adder ADD1, the wave start address from the assignment memory 46 is added to the integer part of the F number, and the address of the waveform ROM 42 is designated by the added data. The sample interpolator 74 reads the sample waveform data with the designated address, and uses the decimal part of the F number to apply an interpolation processing to the sample waveform data.

The sample waveform data outputted from the sample interpolator 74 is transmitted to a multiplier MLT1. In the multiplier MLT1, the envelope data from the envelope generator 76 is inputted, and the sample waveform data is multiplied by the envelope data. The envelope data is based on the attack, decay and release envelope data supplied to the envelope generator 76 from the assignment memory 46. Furthermore, in a multiplier MLT2, the sample waveform data is multiplied by the loudness data from the assignment memory 46.

The sample waveform data obtained by multiplying the envelope data and the loudness data as described above is transmitted to the panning circuit 50.

The panning circuit 50 includes an L side series constituted of an L side panning value interpolation circuit 50L and a multiplier MLT3, and an R side series constituted of an R side panning value interpolation circuit 50R and a multiplier MLT4. The series accumulation circuit 60 on the downstream side also includes the L side series constituted of an adder ADD3 and a latch 60L, and the R side series constituted of an adder ADD4 and a latch 60R.

The L side panning value interpolation circuit 50L and the R side panning value interpolation circuit 50R are notified of the presence/absence of interpolation from the CPU 24, and transmit the panning coefficients (pan values) obtained from the assignment memory 46 to the multipliers MLT3, MLT4 when there is interpolation. When the panning coefficients are transmitted to the multipliers MLT3, MLT4, the sample waveform data are multiplied by the panning coefficients.

Furthermore, the sample waveform data are transmitted to the latches 60L, 60R via the adders ADD3, ADD4, and an accumulation processing is performed for all channels. The accumulated data is analog-converted, amplified, and outputted as sound in the left and right output systems as described above.

Figure 7:
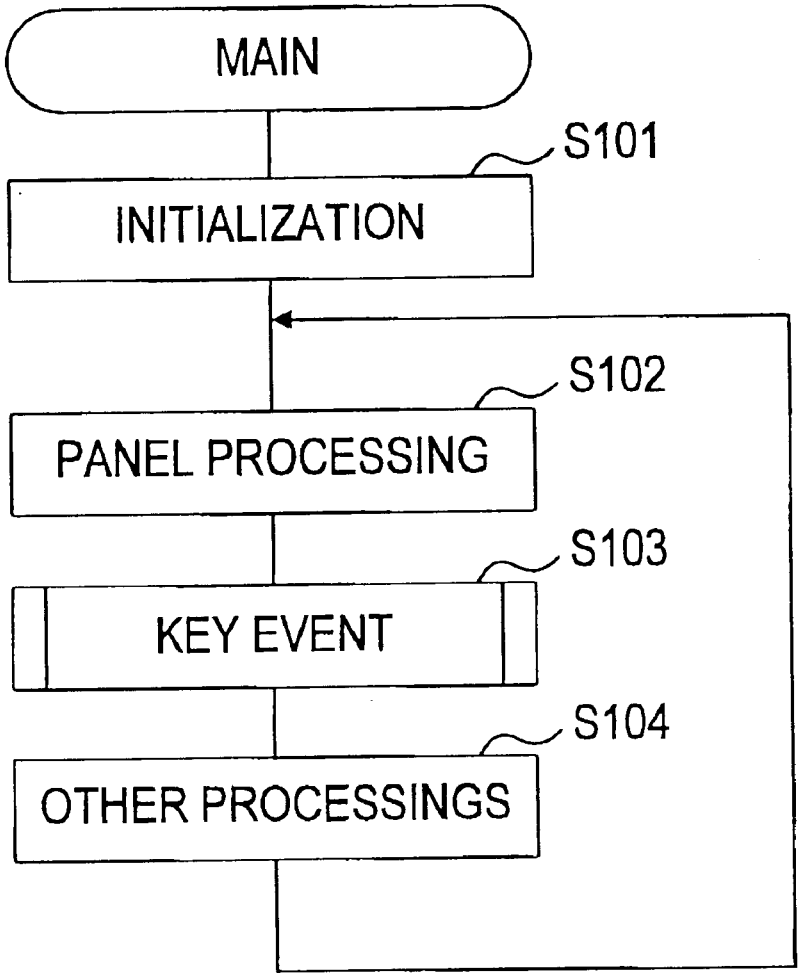
FIG. 7 is a flowchart showing a main processing executed by CPU of the electronic instrument of the embodiment.

Additionally, in this electronic instrument 10, as shown in FIG. 7, when the power source of the electronic instrument 10 is turned on, the CPU 24 performs various initialization processings (S101).

Thereafter, a panel processing (S102) for setting the timbre, sound volume, and the like in accordance with the on/off state, position, and the like of the mode selection switch, timbre selection switch, and volume controller on the panel 14, a key event processing (S103) for performing the sounding or silencing in accordance with the key on/off state, and other processings (S104) are repeatedly performed.

Figure 8:
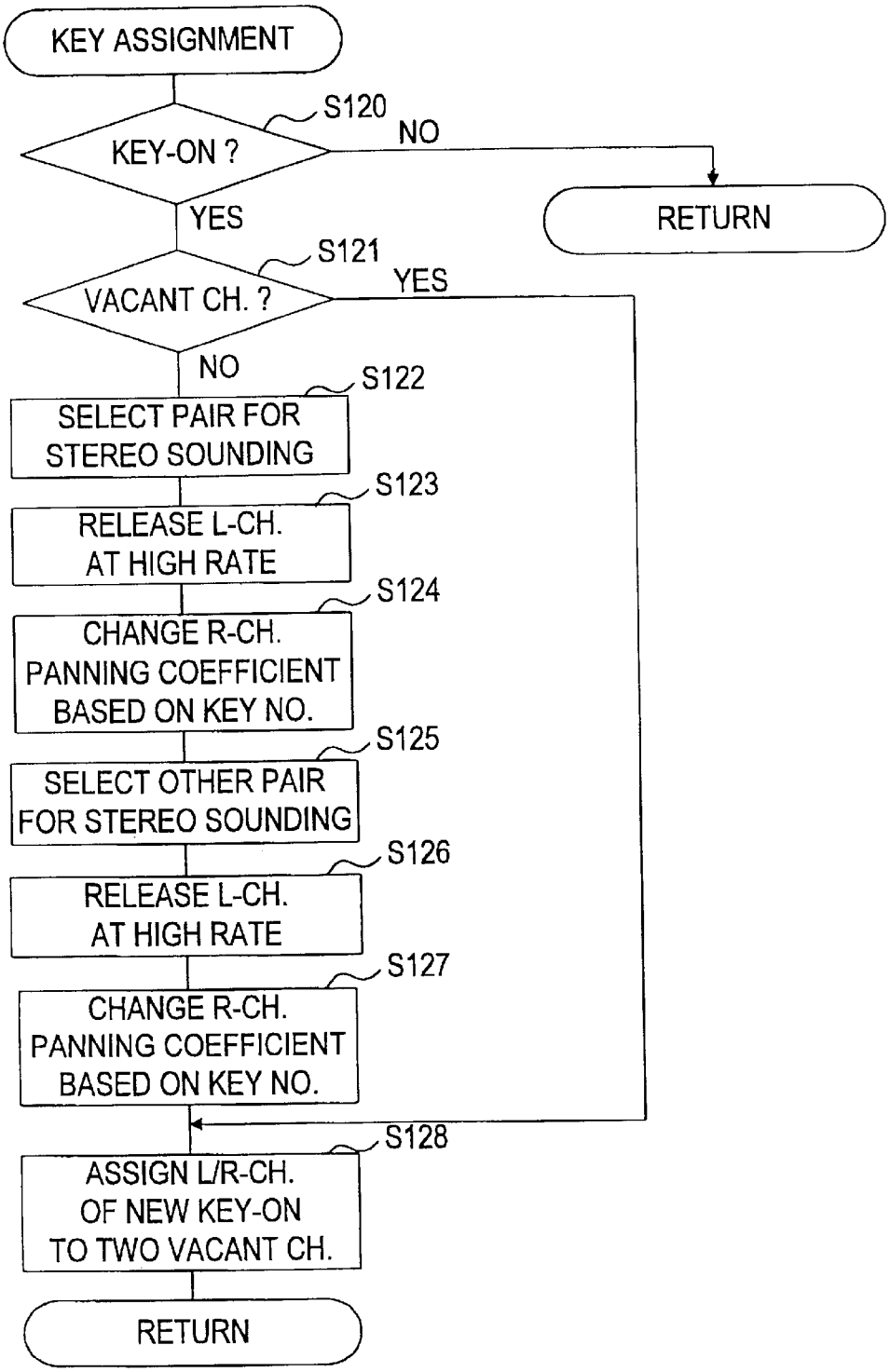
FIG. 8 is a flowchart showing a key assignment processing executed by the CPU of the electronic instrument of the embodiment.

A key assignment processing deeply related with the present invention is performed as a sub-routine included in the key event (S103). The processing will next be described with reference to FIG. 8.

In the key assignment processing, the CPU 24 first determines whether key-on is present (S120). When there is a key-on, the CPU 24 searches the CPU work RAM 30 and determines whether or not there are two vacant channels (S121). When there is no vacant channel, one pair of channels for stereo sounding is selected (S122). The selection criterion may appropriately be set, and in the present embodiment the pair of channels which have started sounding most previously are selected.

Figure 6:
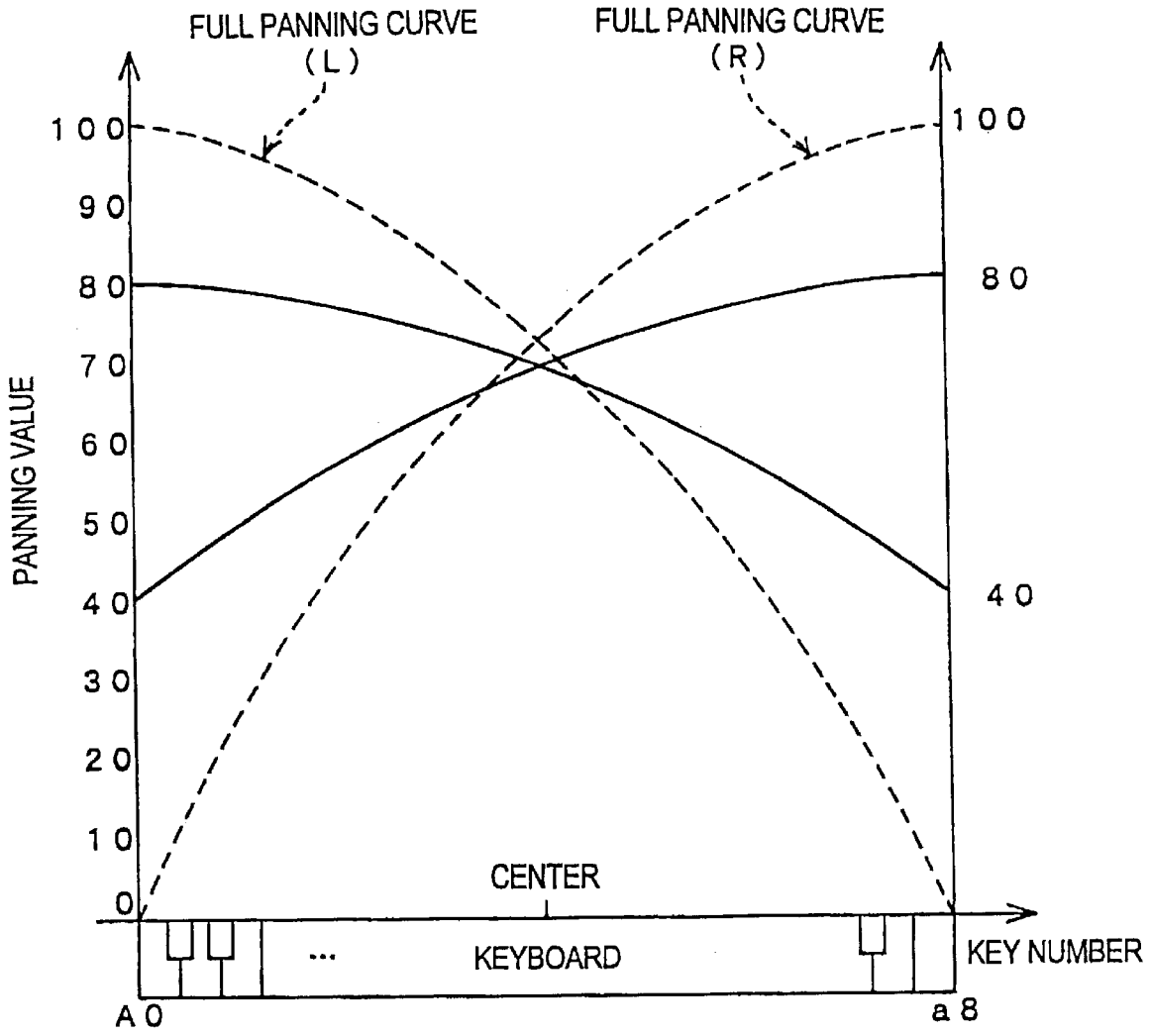
FIG. 6 is a graph showing a panning curve of a monaural piano sound in the electronic instrument of the embodiment.

Subsequently, the CPU 24 instructs the musical sound signal generator 40 to release, that is, truncate one channel (L channel in this embodiment) of the selected pair of channels at a high rate (S123). Moreover, the CPU 24 instructs the musical sound signal generator 40 to change the panning coefficient of the other channel (R channel in this embodiment) of the selected pair of channels based on the key number, so that the monaural sound of the R channel is outputted from the left and right output systems (S124). This panning coefficient for the key number is determined, for example, by the panning curve shown in FIG. 6. FIG. 6 shows the example of the panning curve of a monaural piano sound, and in the present embodiment, the 80–40 panning curve and 40–80 panning curve are used. However, other panning curves such as full panning curves L, R may be used.

Additionally, the high rate release is realized by the function of the envelope generator 76, and the panning change is realized by the function of the panning circuit 50. Therefore, the CPU 24 for instructing the monaural sounding, the envelope generator 76 for realizing the instruction and the panning circuit 50 cooperate to function as a monaural unit and a correction panning unit.

Subsequently, the CPU 24 selects the other pair of channels for the stereo sounding (S125), releases one channel (L channel in the present embodiment) of the selected pair of channels (S126), changes the panning coefficient of the other channel (R channel in the embodiment) based on the key number, and allows the left and right output systems to output the monaural sound (S127).

Since two vacant channels are obtained in this manner, the L and R channels of the new key-on are assigned to the channels (S128). Specifically, the data with the content shown in FIG. 3 is written to the area corresponding to the two vacant channels on the assignment memory 46, and the storage of the operation state of the musical sound generation channel in the CPU work RAM 30 is updated.

Additionally, when there is no key-on (NO at S120), the flow returns without performing the processings of S121 and the subsequent steps. When there is a vacant channel (YES at S121), the processings of S122 to S127 are skipped and the processing of S128 is executed.

As described above, when a new key-on is made and there is no vacant channel to be assigned, two pairs of channels are selected, one channel of each pair of channels is truncated to create two vacant channels, and the channels are assigned for the new key-on. Therefore, the stereo sounding for the new key-on is enabled. Additionally, since the panning coefficient of the non-truncated channel is changed and outputs are emitted from both the left and right output systems Therefore, the left/right balance can be maintained. Moreover, the remaining monaural sound can prevent the sound volume from decreasing by the truncation. For example, when the key-on is successively made with the damper pedal stepped on, the total sound volume can gradually be increased.

Modification

Figure 9:
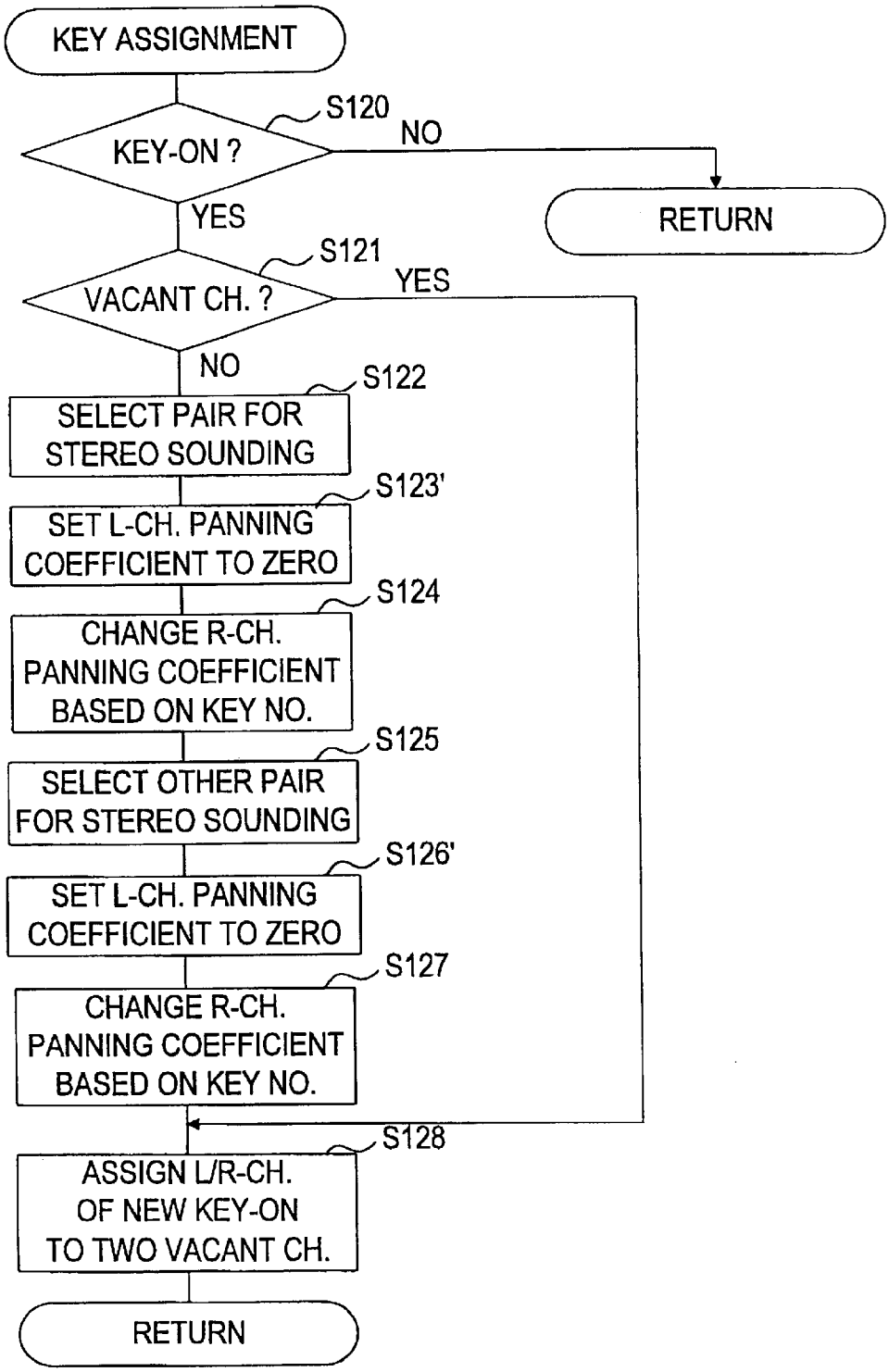
FIG. 9 is a flowchart showing the modification example of the key assignment processing.

In the above-described embodiment, the technique of releasing one channel of the pair of channels at the high rate is employed. However, as shown in FIG. 9, even when the L channel panning coefficient is set to zero (S123', S126'), two vacant channels can be created and assigned to the new key-on, and the monaural sound of the remaining channel can prevent the total sound volume from decreasing.

Second Embodiment

Since the constitutions and flows of a second embodiment are similar to those of the first embodiment, the description thereof is omitted.

Figure 10:
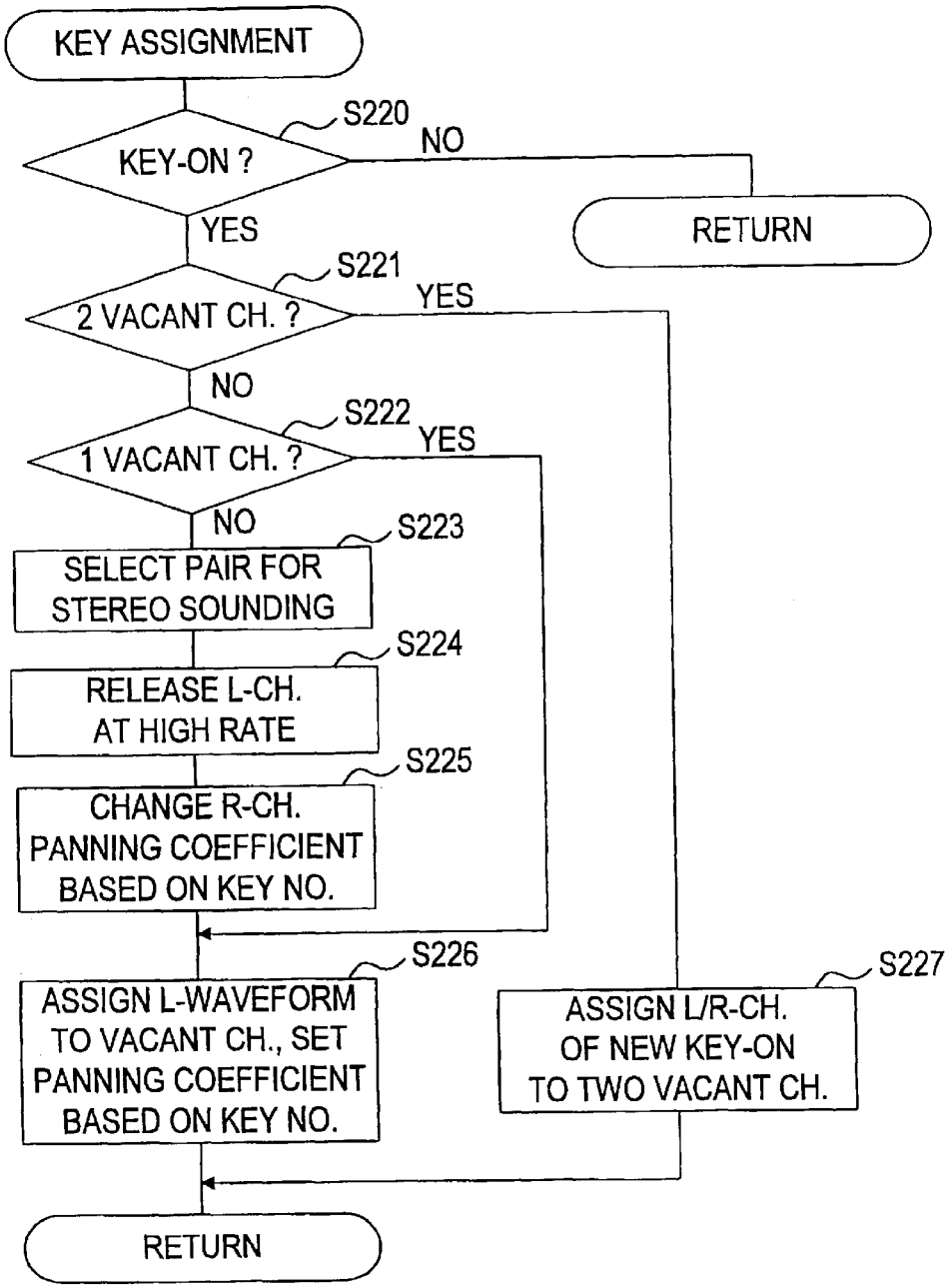
FIG 10 is a flowchart showing the key assignment processing executed by the CPU of the electronic instrument of a second embodiment.

The key assignment processing of the second embodiment is performed as the sub-routine included in the key event (S103). The processing will be described with reference to FIG. 10.

In the key assignment processing, the CPU 24 first determines whether the key-on is present (S220). When there is a key-on, the CPU 24 searches the CPU work RAM 30 and determines whether or not there are two vacant channels (S221).

When there are two or more vacant channels (YES at S221), two vacant channels are selected, and L and R channels of the new key-on are assigned to the selected channels (S227). Specifically, the data of the content shown in FIG. 3 is written to the area corresponding to two vacant channels on the assignment memory 46, and the storage of the operation state of the musical sound generation channel of the CPU work RAM 30 is updated.

When the number of vacant channels is less than two (NO at S221), it is determined whether or not there is one vacant channel (S222).

Here, when negative determination is made (NO at S222), the vacant channel is secured as follows to assign the new key-on.

First, one pair of channels for stereo sounding is selected (S223). The selection criterion may appropriately be set, and in the present embodiment the pair of channels which have started sounding most previously are selected.

Subsequently, the CPU 24 instructs the musical sound signal generator 40 to release, that is, truncate one channel (L channel in this embodiment) of the selected pair of channels at the high rate (S224). Moreover, the CPU 24 instructs the musical sound signal generator 40 to change the panning coefficient of the other channel (R channel in this embodiment) of the selected pair of channels based on the key number, so that the monaural sound of the R channel is outputted from the left and right output systems (S225). This panning coefficient corresponding to the key number is determined, for example, by the panning curve shown in FIG. 6. Moreover, by setting the panning coefficient, for example, the sound volume immediately before one channel is released at the high rate can be secured by the remaining channel, so that the total sound volume decrease can be prevented.

Additionally, the high rate release is realized by the function of the envelope generator 76, and the panning change is realized by the function of the panning circuit 50.

Subsequently, the L waveform of the new key-on is assigned to the high-rate released channel or the channel determined to be vacant at S122, the panning coefficient is set based on the key number subjected to the key-on, and the monaural sound is outputted from the left and right output systems (S226).

Specifically, in a similar manner as the first embodiment, the CPU 24 determines the panning coefficient corresponding to the key number by the panning curve shown in FIG. 6, writes the data with the content shown in FIG. 3, including the panning coefficient, to the area corresponding to the vacant channel on the assignment memory 46, and updates the storage of the operation state of the musical sound generation channel in the CPU work RAM 30. Additionally, in the present embodiment, the above-described panning curves are employed, but other panning curves such as full panning curves L, R may be used.

As described above, when the new key-on is detected and there are two or more vacant channels, two channels are selected, and the L and R channels of the new key-on are assigned to the selected channels (S227), so that the stereo sounding for the new key-on is performed.

On the other hand, when only one channel is vacant, the L waveform of the new key-on is assigned to the channel, the panning coefficient is set based on the key number subjected to the key-on, and the monaural sound (the sound based on the L waveform in this embodiment) is outputted from the left and right output systems, so that the left/right sound volume balance is not destroyed. In this case, since the panning coefficient is set in accordance with the key umber, a pseudo stereo effect can be produced, which gives no feeling of difference to the players and audience. Additionally, since only the setting of the panning coefficient is necessary, there is hardly a load increase of the CPU 24, and no high-performance expensive CPU needs to be employed.

Additionally, in this embodiment, the CPU 24 functions as an assigning unit and cooperates with the panning circuit 50 to function as a panning setting unit.

Third Embodiment

In the above-described second embodiment, the stereo assignment or the monaural assignment is selected based on the number of vacant channels, but the stereo assignment or the monaural assignment can be selected based on the key velocity. The latter case will be described as a third embodiment. Additionally, since the hardware constitution, main processing, and the like of the third embodiment are similar to those of the first embodiment, the description is omitted.

Figure 11:
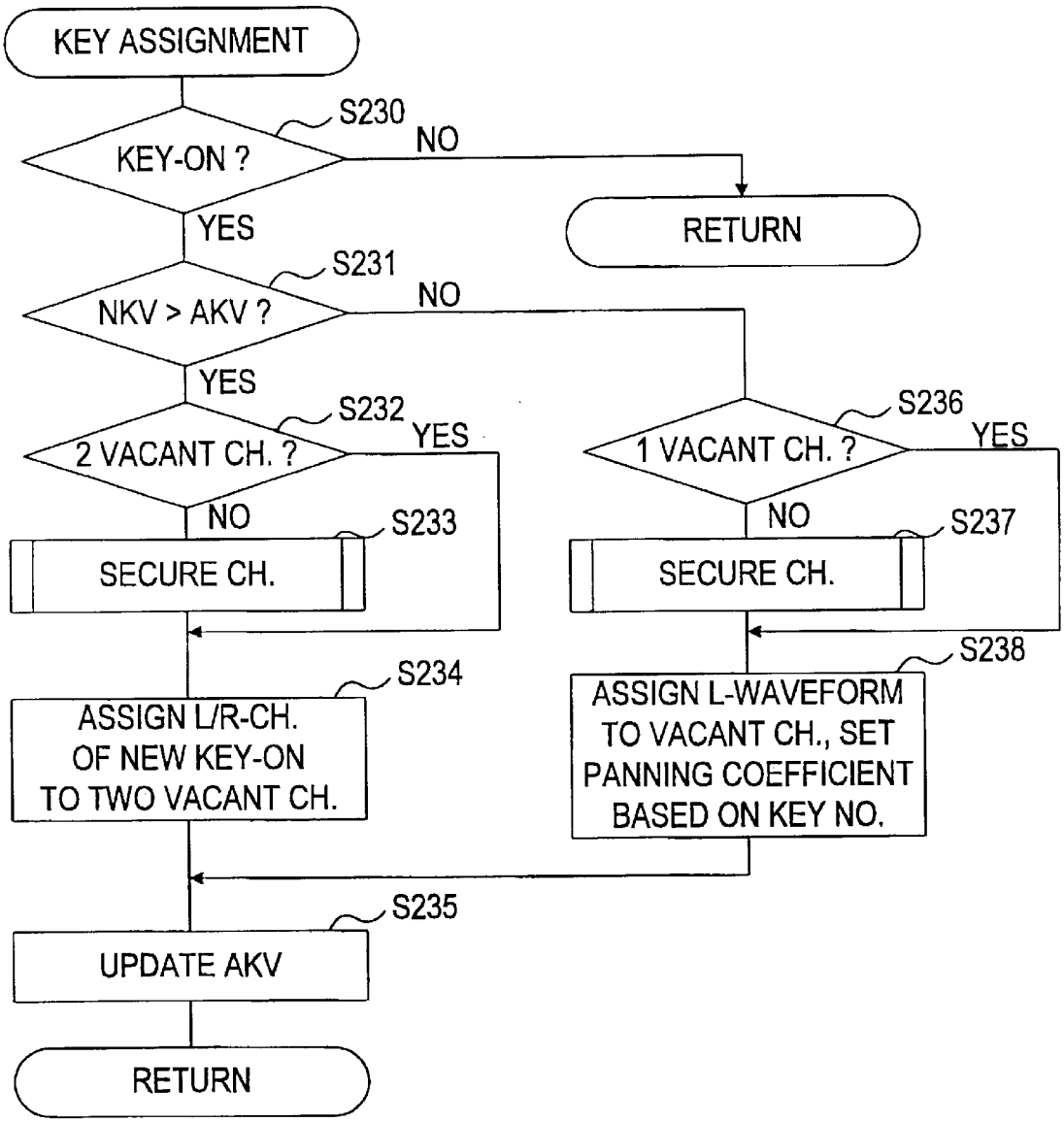
FIG. 11 is a flowchart showing the key assignment processing executed by the CPU of the electronic instrument of a third embodiment.

The key assignment processing of the CPU 24 of the third embodiment is shown in FIG. 11. First, it is determined whether or not there is a key-on (S230). When there is a key-on, an average velocity value AKV is read from the CPU work RAM 30, the average velocity value AKV is compared with a new key-on velocity NKV, and it is determined whether or not the new key-on velocity NKV exceeds the average velocity value AKV (S231). Additionally, the average velocity value indicates the average value of the velocities of the keys already assigned when the new key-on is detected, and can be said to be the average value of the velocities of the keys which are now sounding.

When the new key-on velocity NKV exceeds the average velocity value AKV (YES at S231), the CPU 24 searches the CPU work RAM 30 to determine whether or not there are two or more vacant channels (S232).

When there are two or more vacant channels (YES at S232), two vacant channels are selected, and the L and R channels of the new key-on are assigned to the selected channels (S234). Specifically, the data with the content shown in FIG. 3 is written to the area corresponding to two vacant channels on the assignment memory 46, and the storage of the operation state of the musical sound generation channel of the CPU work RAM 30 is updated.

However, when the number of vacant channels is less than two (NO at S232), a channel securement processing (S233) is executed to use any one of the presently assigned channels for the new key-on, and the above-described S233 is then executed.

Figure 12:
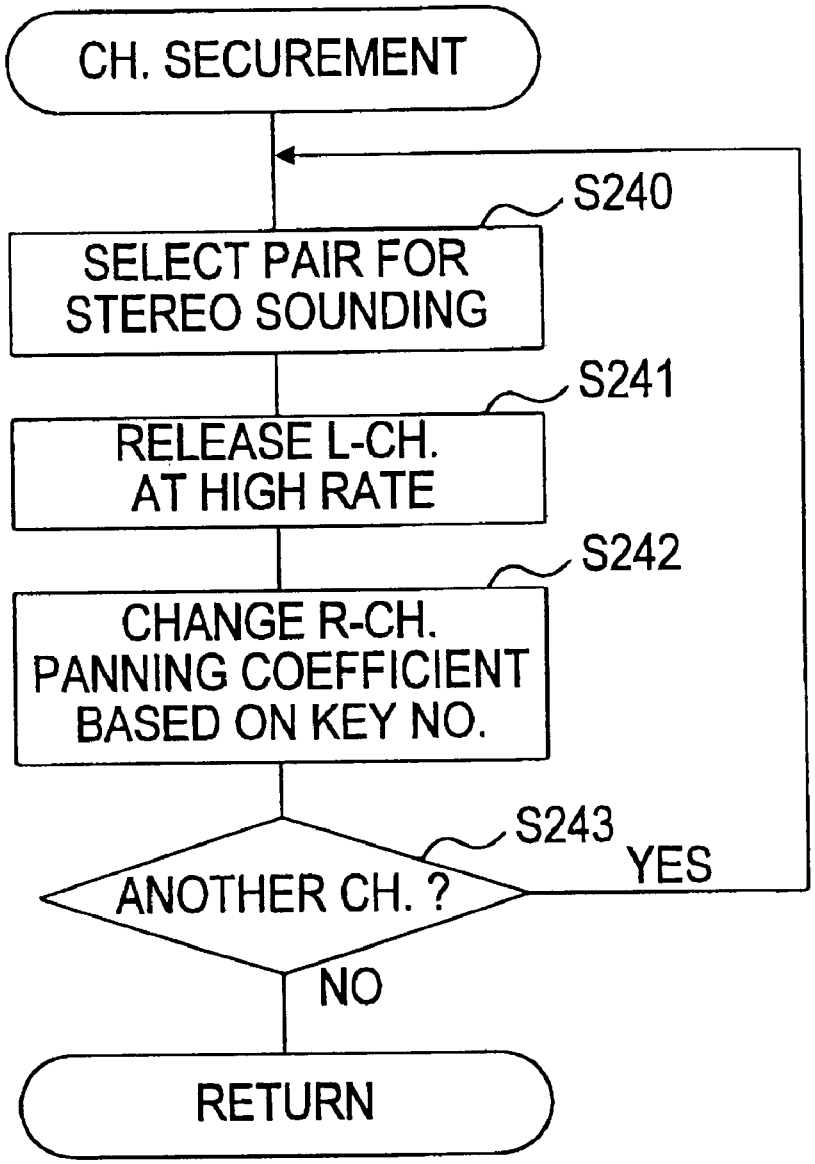
FIG. 12 is a flowchart showing a channel ensuring processing executed by the CPU of the electronic instrument of the third embodiment.

The channel securement processing is shown in FIG. 12. First, one pair of channels for the stereo sounding are secured (S240). The selection criterion may appropriately be set, and in the present embodiment the pair of channels which have started sounding most previously are selected.

Subsequently, the CPU 24 instructs the musical sound signal generator 40 to release, that is, truncate one channel (L channel in this embodiment) of the selected pair of channels at the high rate (S241). Moreover, the CPU 24 instructs the musical sound signal generator 40 to change the panning coefficient of the other channel (R channel in this embodiment) of the selected pair of channels based on the key number, so that the monaural sound of the R channel is outputted from the left and right output systems (S242). This panning coefficient corresponding to the key number is determined, for example, by the panning curve shown in FIG. 6. Moreover, by setting the panning coefficient, for example, the sound volume immediately before one channel is released at the high rate can be secured by the remaining channel, so that the total sound volume decrease can be prevented.

Subsequently, when another channel needs to be secured (YES at S243), the flow returns to S240 in which in a similar manner as above, the other pair of channels for the stereo sounding are selected (S240). One channel of the selected pair of channels (L channel in the present embodiment) is released at the high rate (S241), the panning coefficient of the other channel of the pair of the channels (R channel in the present embodiment) is changed based on the key number, and the monaural sound is outputted from the left and right output systems (S242).

As described above, one channel or two channels can be secured as the vacant channel. Since two vacant channels are secured, as shown in FIG. 11, the L and R channels of the new key-on are assigned to the two channels (S234). Specifically, the data with the content shown in FIG. 3 is written to the area corresponding to two vacant channels on the assignment memory 46, and the storage of the operation state of the musical sound generation channel of the CPU work RAM 30 is updated.

Subsequently, the CPU 24 calculates a new average velocity value AKV from the new key-on velocity NKV and the average velocity value AKV, and stores the value into the CPU work RAM 30 (S235).

On the other hand, when the negative determination is made at S231, and the new key-on velocity NKV is equal to or less than the average velocity value AKV, the CPU 24 searches the CPU work RAM 30 and determines whether or not there is one or more vacant channels (S236).

When there is one or more vacant channels (YES at S236), one channel is selected, the L waveform of the new key-on is assigned to the channel, the panning coefficient is set based on the key number subjected to the key-on, and the monaural sound is outputted from the left and right output systems (S238).

Moreover, when there is no even one vacant channel (NO at S236), the channel securement processing (S237) is executed to use any one of the presently assigned channels for the new key-on, and the above-described S238 is then executed. The channel securement processing executed here is the same as that executed at S233 (refer to FIG. 12). However, since only one channel may be secured, the affirmative determination is not made at S243, and the flow does not return to S240.

As described above, when the new key-on is made, and when the key velocity NKV is equal to or less than the average velocity value AKV, that is, when the key velocity is relatively low, the monaural sounding is performed. Therefore, the musical sound generation channel can effective be utilized.

What is claimed is:

1. A musical sound signal generation apparatus provided with: a plurality of musical sound generation channels for generating musical sound signals; channel state storage means for storing the operation state of each of said musical sound generation channels; assigning means for, when a key-on is detected, referring to the storage content of said channel state storage means to select a pair of said musical sound generation channels, assigning a left musical sound signal for stereo performance to one of the selected musical sound generation channels which is an L channel, and assigning a right musical sound signal for the stereo performance to the other channel which is an R channel; a left output system for outputting said left musical sound signal; and a right output system for outputting said right musical sound signal, said musical sound signal generation apparatus comprising:

monaural processing means for, when the new key-on is detected, referring to the storage content of said channel state storage means, selecting two pairs of said L channel and R channel corresponding to two keys previously subjected to the key-on, truncating the musical sound signal of one channel of each selected pair of said musical sound generation channels, and setting output destination of the musical sound signal of the other musical sound generation channel to both said left output system and the right output system.

2. The musical sound signal generation apparatus according to claim 1 wherein said assigning means assigns said left musical sound signal corresponding said new key-on to one of said two musical sound generation channels truncated by said monaural processing means which is the L channel, and assigns said right musical sound signal corresponding to said new key-on to the other channel which is the R channel.

3. The musical sound signal generation apparatus according to claim 1 further comprising:

correction panning means for applying a panning processing to both or one of a left output and a right output with respect to the musical sound signal whose output destination is set to both the left output system and the right output system by said monaural processing means.

4. A musical sound signal generation apparatus provided with: a plurality of musical sound generation channels for generating musical sound signals; channel state storage means for storing the operation state of each of said musical sound generation channels; assigning means for, when a key-on is detected, referring to the storage content of said channel state storage means to select a pair of said musical sound generation channels, assigning a left musical sound signal for stereo performance to one of the selected musical sound generation channels which is an L channel, and assigning a right musical sound signal for said stereo performance to the other channel which is an R channel; a left output system for outputting said left musical sound signal; and a right output system for outputting said right musical sound signal, said musical sound signal generation apparatus comprising:

gradual panning means for, when the new key-on is detected, referring to the storage content of said channel state storage means, selecting one pair of said L channel and R channel corresponding to the key previously subjected to the key-on, allowing the panning value of the musical sound signal of one channel of said selected musical sound generation channels to gradually approach zero (hereinafter referred to as the gradual approach to zero), and allowing the musical sound signal of the other musical sound generation channel to gradually approach the panning value based on a key scale during said key-on which is a cue to operate the musical sound generation channel (hereinafter referred to as the gradual approach to the key scale).

5. The musical sound signal generation apparatus according to claim 4 wherein a speed of said gradual approach to zero is the same as the speed of said gradual approach to the key scale.

6. The musical sound signal generation apparatus according to claim 4 wherein the sum of sound volumes of the musical sound signal for said gradual approach to zero and the musical sound signal for said gradual approach to the key scale is constant.

7. A musical sound signal generation apparatus provided with: a plurality of musical sound generation channels for generating musical sound signals; channel state storage means for storing the operation state of each of said musical sound generation channels; assigning means for, when a key-on is detected, referring to the storage content of said channel state storage means to select a pair of said musical sound generation channels, assigning a left musical sound signal for stereo performance to one of the selected musical sound generation channels which is an L channel, and assigning a right musical sound signal for said stereo performance to the other channel which is an R channel; a left output system for outputting said left musical sound signal; and a right output system for outputting said right musical sound signal, said musical sound signal generation apparatus comprising:

panning changing means for, when the new key-on is detected, referring to the storage content of said channel state storage means, selecting one pair of said L channel and R channel corresponding to the key previously subjected to the key-on, and changing the panning value of one musical sound generation channel to obtain a sound volume close to the total value of the sound volume outputted by the selected L and R channels in one of the selected L and R channels.

8. The musical sound signal generation apparatus according to claim 7 further comprising:

rapid silencing means for rapidly silencing the musical sound signal of the musical sound generation channel whose panning value is not changed by said panning changing means out of the selected pair of musical sound generation channels attributed to said new key-on.

9. A musical sound signal generation apparatus provided with: a plurality of musical sound generation channels for generating musical sound signals; channel state storage means for storing the operation state of each of said musical sound generation channels; assigning means for, when a new key-on is detected, referring to the storage content of said channel state storage means to assign said musical sound generation channel to generate the musical sound signal corresponding to the new key-on; and left and right output systems for outputting the musical sound signal generated by said musical sound generation channel, said assigning means being constituted to, on the detection of the new key-on, assign a pair of said musical sound generation channels to generate left and right independent waveforms (hereinafter referred to as stereo-assign) when there is a vacancy of two or more channels in said musical sound generation channel, and to assign one musical sound generation channel to generate only one of said left and right independent waveforms (hereinafter referred to as monaural-assign) when there is no vacancy of two or more channels, said musical sound signal generation apparatus comprising:

panning setting means for setting a panning coefficient so that the musical sound signal of said musical sound generation channel monaural-assigned by the assigning means is outputted from said left and right output systems.

10. The musical sound signal generation apparatus according to claim 9 wherein said panning setting means sets the panning coefficient of the musical sound signal of said monaural-assigned musical sound generation channel based on a sound range of said new key-on.

11. The musical sound signal generation apparatus according to claim 9 wherein when said new key-on is detected and said musical sound generation channels to which the new key-on is to be assigned fall short, said assigning means selects either one of said already assigned musical sound generation channels, and assigns said new key-on to the selected musical sound generation channel.

12. A musical sound signal generation apparatus provided with: a plurality of musical sound generation channels for generating musical sound signals; channel state storage means for storing the operation state of each of said musical sound generation channels; assigning means for, when a new key-on is detected, referring to the storage content of said channel state storage means to assign said musical sound generation channel to generate the musical sound signal corresponding to the new key-on; and left and right output systems for outputting the musical sound signal generated by said musical sound generation channel, said assigning means being constituted to assign a pair of said musical sound generation channels to generate left and right independent waveforms (hereinafter referred to as stereo-assign) when a velocity of said new key-on exceeds a velocity reference value, and to assign one musical sound generation channel to generate only one of said left and right independent waveforms (hereinafter referred to as monaural-assign) when the velocity of said new key-on is equal to or less than the velocity reference value, said musical sound signal generation apparatus comprising:

panning setting means for setting a panning coefficient so that the musical sound signal of said musical sound generation channel monaural-assigned by the assigning means is outputted from said left and right output systems.

13. The musical sound signal generation apparatus according to claim 12 wherein said velocity reference value is determined based on the velocity of the key to which the musical sound generation channel is already assigned when said new key-on is detected.

14. The musical sound signal generation apparatus according to claim 13 wherein said velocity reference value is an average value of the velocity of the key to which the musical sound generation channel is already assigned when said new key-on is detected.

15. The musical sound signal generation apparatus according to claim 12 wherein said panning setting means sets the panning coefficient of the musical sound signal of said monaural-assigned musical sound generation channel based on a sound range of said new key-on.

16. The musical sound signal generation apparatus according to claim 12 wherein when said new key-on is detected and said musical sound generation channels to which the new key-on is to be assigned fall short, said assigning means selects either one of said already assigned musical sound generation channels, and assigns said new key-on to the selected musical sound generation channel.

* * * * *